US011094233B2

(12) United States Patent
Sakurai

(10) Patent No.: US 11,094,233 B2
(45) Date of Patent: Aug. 17, 2021

(54) DISPLAY MEDIUM, DISPLAY-SUPPORT MEDIUM, PROCESSING APPARATUS AND PROCESSING PROGRAM

(71) Applicant: DWANGO Co., Ltd., Tokyo (JP)

(72) Inventor: Kaisei Sakurai, Tokyo (JP)

(73) Assignee: DWANGO, Co., Ltd., Tokyo (JP)

( * ) Notice: Subject to any disclaimer, the term of this patent is extended or adjusted under 35 U.S.C. 154(b) by 161 days.

(21) Appl. No.: 16/322,478

(22) PCT Filed: Oct. 2, 2018

(86) PCT No.: PCT/JP2018/036798
§ 371 (c)(1),
(2) Date: Jan. 31, 2019

(87) PCT Pub. No.: WO2019/150652
PCT Pub. Date: Aug. 8, 2019

(65) Prior Publication Data

US 2020/0349872 A1 Nov. 5, 2020

(30) Foreign Application Priority Data

Feb. 2, 2018 (JP) ..... JP2018-017219

(51) Int. Cl.
*G09F 19/14* (2006.01)
*G09F 13/14* (2006.01)
(Continued)

(52) U.S. Cl.
CPC ..... *G09F 19/14* (2013.01); *G09F 13/14* (2013.01); *G09F 13/22* (2013.01); *G09F 19/20* (2013.01); *G09F 2013/142* (2013.01)

(58) Field of Classification Search
CPC ..... G09F 19/14; G09F 13/14; G09F 13/22; G09F 19/20; G09F 2013/142
See application file for complete search history.

(56) References Cited

U.S. PATENT DOCUMENTS 4,588,212 A * 5/1986 Castagnoli ..... B42D 25/29 283/91
5,032,003 A * 7/1991 Antes ..... B42D 25/324 359/567
(Continued)

FOREIGN PATENT DOCUMENTS

CN 1147234 A 4/1997
CN 101053006 A 10/2007
(Continued)

OTHER PUBLICATIONS

English Translation of Decision to Grant a Patent dated Jul. 5, 2018 for Japanese Application No. 2018-017219.
(Continued)

*Primary Examiner* — Cassandra Davis
(74) *Attorney, Agent, or Firm* — Dorsey & Whitney LLP

(57) ABSTRACT

A display medium displays a predetermined number of contents corresponding to a predetermined number of azimuth angles when viewed from a predetermined elevation angle and azimuth angle. An example display medium includes: a planar member that reflects light; and a plurality of protruding members, each protruding member of the plurality of protruding members has a surface occluding the light, placed vertically on the planar member and parallel to each of the predetermined number of azimuth angles. The planar member is partitioned into a plurality of unit cells, where each unit cell is further partitioned into the predetermined number of sub-cells corresponding to the predetermined number of azimuth angles. The protruding member that has the surface parallel to the predetermined azimuth angle is formed for each sub-cell corresponding to the predetermined azimuth angle.

18 Claims, 11 Drawing Sheets

(51) Int. Cl.
*G09F 13/22* (2006.01)
*G09F 19/20* (2006.01)

(56) References Cited

U.S. PATENT DOCUMENTS

| | | | |
|---|---|---|---|
| 5,695,346 | A | 12/1997 | Sekiguchi et al. |
| 2008/0284157 | A1 | 11/2008 | Muke et al. |
| 2008/0314441 | A1 | 12/2008 | Mather |
| 2014/0226093 | A1 | 8/2014 | Schwartz et al. |

FOREIGN PATENT DOCUMENTS

| | | | |
|---|---|---|---|
| CN | 101576661 | A | 11/2009 |
| CN | 101765516 | A | 6/2010 |
| CN | 102016963 | A | 4/2011 |
| JP | H06255231 | A | 9/1994 |
| JP | H07164799 | A | 6/1995 |
| JP | 2002099223 | A | 4/2002 |
| WO | 2006049213 | A1 | 5/2006 |

OTHER PUBLICATIONS

English Translation of Notification of Reasons for Refusal dated Apr. 26, 2018 for Japanese Application No. 2018-017219.
International Search Report dated Nov. 2, 2018 received in related International Application No. PCT/JP2018/036798, 10 pages.
1st Office Action for CN Application No. 201880003077.0, dated Apr. 22, 2020.

* cited by examiner

DISPLAY MEDIUM, DISPLAY-SUPPORT MEDIUM, PROCESSING APPARATUS AND PROCESSING PROGRAM

RELATED APPLICATIONS

This application is a U.S. National Stage filing under 35 U.S.C. § 371 PCT Application No, PCT/JP2018/036798, filed Oct. 2, 2018, which claims priority to Japanese Application No. 2018-017210, filed Feb. 2, 2018, which applications are incorporated herein by reference, in their entirety, for any purpose.

DETAILED DESCRIPTION OF THE INVENTION

Technical Field

This invention is related to a display medium, a display-support medium, a processing apparatus and a processing program that enable to display a predetermined number of contents corresponding to a predetermined number of azimuth angles when viewed from predetermined elevation and azimuth angles.

Background Technology

For displaying information efficiently, there are display media capable of displaying a plurality of pieces of information (see Patent Literature 1). According to the invention described in Patent Literature 1, a plurality of self-luminescent elements are installed on the display surface of the signboard in which some of self-luminescent elements are aligned toward the left oblique direction while others are aligned toward the right oblique direction. A unique display is realized in each direction by the self-luminescent elements. The signboard is configured such that one display cannot be viewed by the other direction. Thus, one signboard can display two types of information. In the patent described in Patent Literature 1, a plurality of holes are provided on the surface of the signboard and the self-luminescent elements are embedded in those holes.

PRIOR ART LITERATURES

Patent Literatures

[Patent Literature 1] Japanese Patent Application Publication No. H08-333727

SUMMARY OF INVENTION

Problems to Be Solved by the Invention

According to the invention described in Patent Literature 1, the self-luminescent elements installed in the left oblique direction and the self-luminescent elements installed in the right oblique direction share common emitting windows. Therefore, if different colors are used for each self-luminescent element, the colors may blend. The invention described in Patent Literature 1 can display information using a single color but is not capable of displaying information using a plurality of desired colors.

Thus, the objective of this invention is to provide a display medium, a display-support medium, a processing apparatus and a processing program for properly displaying a predetermined number of contents corresponding to a predetermined number of azimuth angles.

Means for Solving Problems

The first feature of this invention for solving the problems is related to a display medium capable of displaying a predetermined number of contents corresponding to a predetermined number of azimuth angles when viewed from predetermined elevation and azimuth angles. The display medium pertinent to the first feature has a planar member that reflects the light, and a plurality of protruding members that are placed vertically on the planar member such that each protruding member has a surface that occludes the tight and is parallel to each of the predetermined number of azimuth angles on the planar member. The planar member is partitioned into a plurality of unit cells, each of which is further partitioned into a predetermined number of sub-cells corresponding to a predetermined number of azimuth angles. In each sub-cell corresponding to a predetermined azimuth angle, the protruding member is configured in a manner that the protruding member has a surface parallel to the predetermined azimuth angle.

The second feature of this invention is related to a display-support medium that is attachable to the display surface having a flat surface reflecting the light, capable of displaying a predetermined number of contents corresponding to a predetermined number of azimuth angles when viewed from predetermined elevation and azimuth angles. The display-support medium pertinent to the second feature of this invention is in a sheet form and is provided with the sheet member that transmits light and with the plurality of protruding members that are placed vertically on the sheet member such that each protruding member has a surface that is parallel to each of the predetermined number of azimuth angles on the sheet member and occludes the light. The sheet member is partitioned into a plurality of unit cells, and each of the plurality of cells is further partitioned into a predetermined number of sub-cells corresponding to a predetermined number of azimuth angles. In each sub-cell corresponding to a predetermined azimuth angle, the protruding member is formed in a manner that the protruding member has a surface parallel to a predetermined azimuth angle.

At this point, in each sub-cell of the unit cell, the area ratio of each sub-cell and the shape of the protruding member may be configured in a manner that the protruding member occludes a smaller amount of light of a predetermined sub-cell when viewed from a predetermined azimuth angle.

Alternatively, in each sub-cell of the unit cell, the area ratio of each sub-cell and the shape of the protruding member may be configured in a manner that the amount of light from directions other than the predetermined direction or from sub-cells other than the predetermined sub-cell is reduced.

Alternatively, in each sub-cell of the unit cell, the area ratio of each sub-cell and the shape of the protruding member may be configured in a manner that the standard deviation of the reflected luminance of the sub-cells is reduced.

Alternatively, when viewed from an elevation angle other than the predetermined elevation angle, a content other than the predetermined number of contents may be displayed.

The third feature of this invention is related to a processing apparatus used in manufacturing the display medium pertinent to the first feature. The processing apparatus pertaining to the third feature of this invention comprises a storage unit, a shape-determining section and a color value computing section.

The storage unit stores the number of contents to be displayed on the display medium, condition data including elevation angles and azimuth angles, and the input color value data storing a color value for each unit cell with respect to each content corresponding to a predetermined number of azimuth angles.

The shape-determining section determines the area ratio of each sub-cell and the shape of the protruding member to reduce: the amount of light of the predetermined sub-cell being occluded by the protruding member when viewed from a predetermined azimuth angle; the amount of light from the directions other than the predetermined direction or from sub-cells other than the predetermined sub-cell; or the standard deviation of the reflected luminance among sub-cells.

The color value computing section computes the color value to be assigned to each sub-cell of the unit cell in a manner that the difference between an observable color value at a predetermined unit cell when the display medium is observed from the predetermined elevation and azimuth angles, and the color value at the corresponding position of the unit cell stored in the input color value data becomes small.

The fourth feature of this invention is related to the processing apparatus used for manufacturing the display-support medium pertinent to the second feature of this invention. The processing apparatus pertaining to the fourth feature of this invention is provided with the storage unit and the shape-determining section. The storage unit stores the number of contents to be supported for displaying by the display-support medium, the condition data including elevation angles and azimuth angles, and the input color value data storing a color value for each unit cell with respect to each content corresponding to a predetermined number of azimuth angles.

The shape-determining section determines the area ratio of each sub-cell and the shape of the protruding member to reduce: the amount of light of the predetermined sub-cell being occluded by the protruding member when viewed from a predetermined azimuth angle; the amount of light from the directions other than the predetermined direction or from sub-cells other than the predetermined sub-cell; or the standard deviation of the reflected luminance among sub-cells.

The fifth feature of this invention is related to the processing apparatus that computes the color value of each position of the display surface corresponding to each sub-cell in order to display a predetermined number of contents on the display surface on which the display-support medium related to the second feature of this invention is attached. The processing apparatus pertaining to the fifth feature of this invention is provided with the storage unit and the color value computing section. The storage unit stores the color value for each unit cell with respect to each content corresponding to a predetermined number of azimuth angles. The color value computing section computes the color values to be assigned to each position of the display surface corresponding to each sub-cell of the unit cell so that the difference between the observable color value at a predetermined unit cell when the display surface on which the display-support medium is attached is observed from the predetermined elevation and azimuth angles, and the color value at the corresponding position of the unit cell with respect to the content at the predetermined azimuth angle is minimized.

The sixth feature of this invention is related to the processing program that is used to operate a computer as the processing apparatus as described in the third through fifth features of this invention.

Effect of the Invention

According to this invention, it is possible to provide the display medium, display-support medium, processing apparatus and processing program for appropriately displaying a predetermined number of contents corresponding to a predetermined number of azimuth angles.

BRIEF DESCRIPTION OF DRAWINGS

FIG. 1(*b*) is a perspective view of a unit cell.

FIG. 5(*b*) is a diagram illustrating the azimuth angles from which the contents of the unit cell shown in FIG. 5(*a*) can be observed.

EMBODIMENTS OF THE INVENTION

Embodiments of this invention will hereafter be described with reference to the drawings. In the descriptions of the drawings, the identical or similar items are indicated with the identical or similar reference codes.

Display Medium

The display medium 1 pertaining to the embodiment of this invention will be described here with reference to FIG.

1. The display medium 1 pertaining to the embodiment of this invention is configured to be able to display the predetermined number of contents corresponding to the predetermined number of azimuth angles when observed from the predetermined elevation and azimuth angles. The display medium 1 can display the content when viewed from the predetermined elevation and azimuth angles, and it can display a different content when the azimuth angle is changed. The display medium 1 can display a plurality of contents for each predetermined azimuth angle. Alternatively, the elevation angle from which the observer views a content may be different for each content. In the embodiment of this invention, the contents are still images.

Figure 1A:
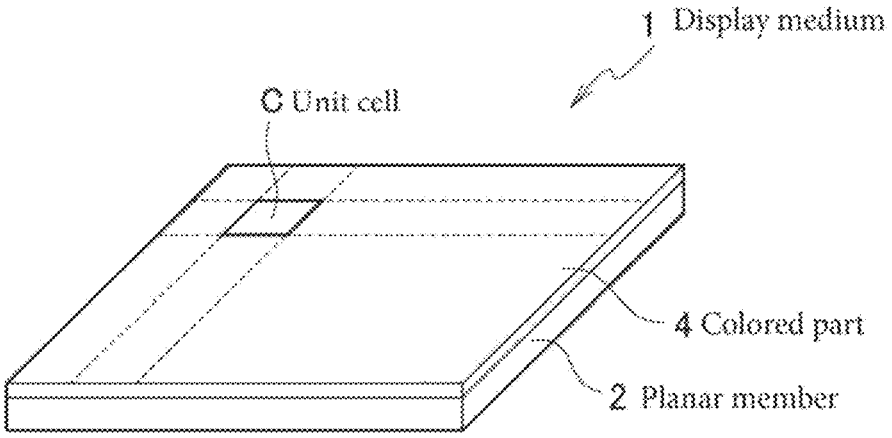
FIG. 1(*a*) is a perspective view of a display medium pertinent to an embodiment of this invention.
Figure 1B:
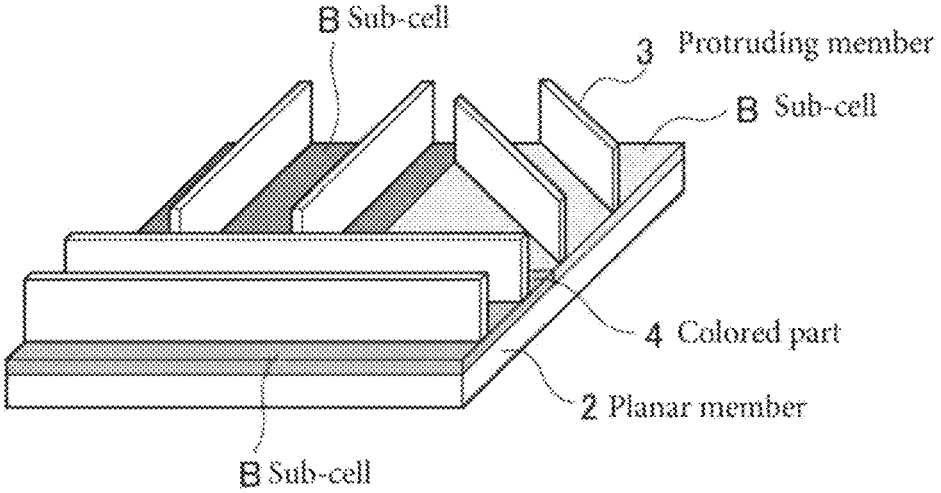

As shown in FIG. 1 (*a*), the display medium 1 provides a planar member 2, where the colored part 4 is arranged on a flat surface of the planer member 2. The planar member 2 has the flat surface that reflects the light. It is sufficient so long as the planar member 2 can mirror-reflect or diffuse the light. Additionally, from the view point of visibility, it is preferable that the planar member 2 is made of the metal with high specular components. The colored part 4 is colored with ink.

As shown in FIG. 1(*a*), the flat surface of the planar member 2 is partitioned into a plurality of unit cells C. Furthermore, as shown in FIG. 1(*b*), each unit cell C is partitioned into the predetermined number of sub-cells B corresponding to the predetermined number of azimuth angles.

Here, a unit cell C and/or a sub-cell B may be a virtual partition. For example, when the same color value is assigned to two adjacent sub-cells B, or depending on positioning of the protruding member 3, the border of the sub-cell B or the unit cell C may not be visualized.

In the example shown in FIG. 1, the description is provided for the case in which the planar member 2 is rectangular. However, it may be in any other form so long as it has a flat surface on which the colored part 4 is arranged. Additionally, the description is provided for the case in which the unit cell C and sub-cell B are rectangular. However, the unit cell C and the sub-cell B can be in any shape.

The number of sub-cells B in each unit cell C corresponds to the number of contents that can be displayed on the display medium 1. For example, in the example shown in FIG. 1, each unit cell C is partitioned into three sub-cells B, therefore at least three contents can be displayed. Furthermore, as shown in the third embodiment variation which is discussed later, depending on the substances of the three contents, four or more contents can be displayed. Of the colored parts 4, for each sub-cell B corresponding to a predetermined azimuth angle, color for each portion corresponding to the position of each sub-cell B, which configures the content corresponding to the predetermined azimuth angle is assigned.

As shown in FIG. 1 (*b*), in the sub-cell B, the plate-like protruding members 3 are placed vertically on the planar member 2. In the example shown in FIG. 1 (*b*), the case in which two protruding members 3 are provided in each sub-cell B is illustrated. However, one or a plurality of protruding members 3 may be provided in each sub-cell B.

The protruding member 3 has a surface that occludes the light and is parallel to each of the predetermined number of azimuth angles on the planar member 2. It is preferable to configure the protruding member 3 using opaque material that occludes the light. However, it may be configured to transmit some portion of the light as long as the light does not affect the visibility of observers. For each sub-cell B corresponding to the predetermined azimuth angle, the protruding member 3 that has a surface parallel to the predetermined azimuth angle is configured.

When a plurality of protruding members 3 are provided in a sub-cell B, all protruding members 3 are placed parallel to each other. When the protruding members 3 are provided on a plurality of sub-cells B, the direction of the set of the protruding members 3 in each sub-cell B is oriented differently from those protruding members 3 provided in other sub-cells B. The set of the protruding members 3 provided in each sub-cell B is oriented such that they are not in parallel to other sets of the protruding members 3 provided in nearby sub-cells B.

The display medium 1 pertaining to the embodiment of this invention is observed from a predetermined elevation angle. As shown in FIG. 1 (*b*), the board-shaped protruding members 3 are placed vertically on the flat surface of the planar member 2. Therefore, when the display medium 1 is observed from the predetermined elevation angle, the portions of the colored part 4 that is not occluded by the protruding members 3 is visible.

The shape of the protruding members 3 and the area ratio of each sub-cell in the unit cell are configured so that at least one or more of the following (1) to (3) is reduced: (1) the amount of light of the predetermined sub-cell being occluded by the protruding member 3 when viewed from the predetermined azimuth angle; (2) the amount of light from directions other than the predetermined direction or from sub-cells B other than the predetermined sub-cell B; and (3) the standard deviation of the reflected luminance of the sub-cells B. The methods for determining the shape of each sub-cell B and the shape of each protruding member 3 will be discussed later in detail.

Figure 2A:
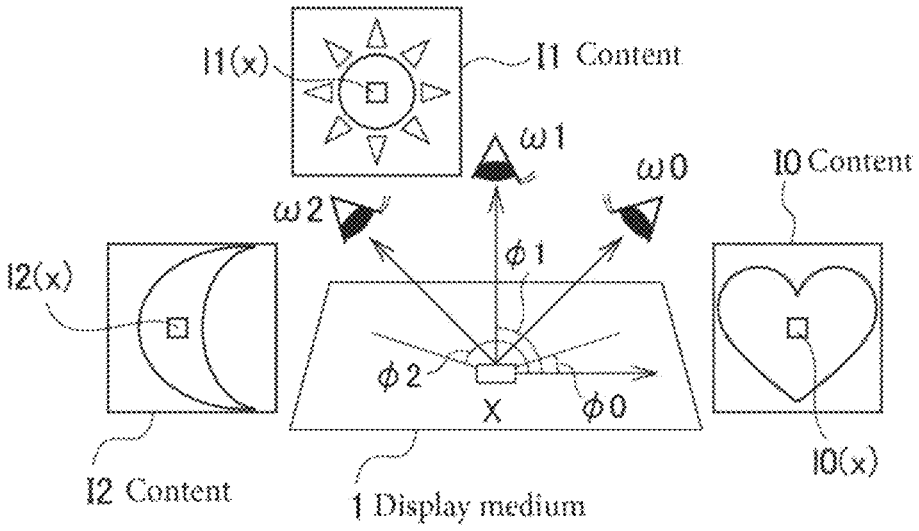
FIG. 2 is a diagram illustrating a relation between the protruding member and the azimuth angle when the content is viewed on the display medium.
Figure 2B:
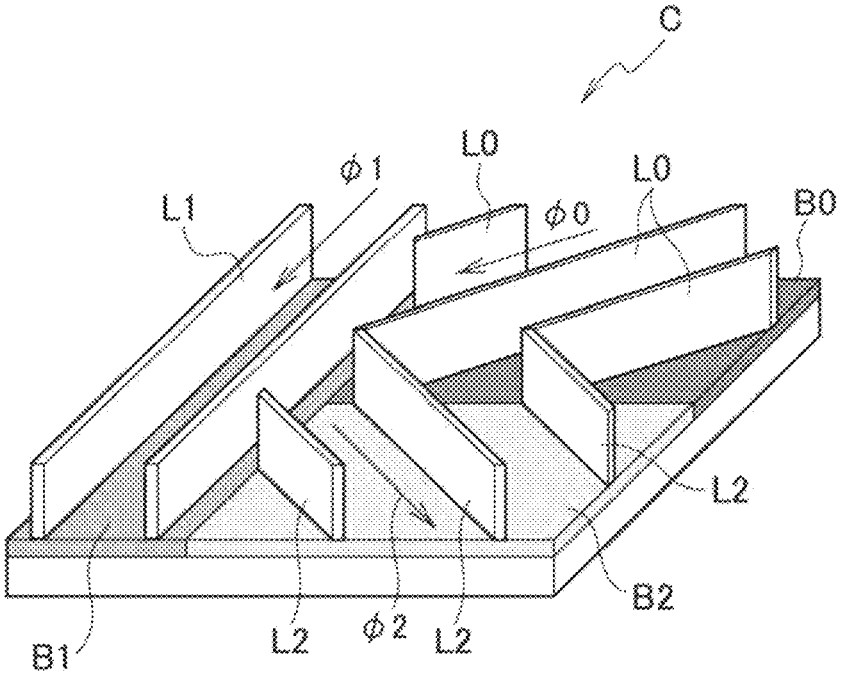

With reference to FIG. 2, the elevation angles and the azimuth angles for observing the display medium 1 pertaining to the embodiment of this invention will be discussed. FIG. 2(*a*) illustrates the case in which contents I0, I1 and I2 are displayed on the display medium 1.

When the coordinate x on the display medium 1 is observed from the predetermined elevation angle ωO and the predetermined azimuth angle φ0, the color value of the content I0 corresponding to the coordinate x on the display medium 1 can be seen. Similarly, when the coordinate x on the display medium 1 is observed from the predetermined elevation angle ω1 and the predetermined azimuth angle φ1, the color value of the content I1 corresponding to the coordinate x on the display medium 1 can be seen. Furthermore, when the coordinate x on the display medium 1 is observed from the predetermined elevation angle ω2 and the predetermined azimuth angle φ2, the color value of the content I2 corresponding to the coordinate x on the display medium 1 can be seen.

The unit cell C of the display medium 1 shown in FIG. 2(*a*) is configured as shown in FIG. 2 (*b*). The unit cell C comprises the sub-cell B0, the sub-cell B1 and the sub-cell B2. On the sub-cell B0, three protruding members L0 are placed parallel to the azimuth angle φ0. On the sub-cell B1, two protruding members L1 are placed parallel to the azimuth angle φ1. On the sub-cell B2, three protruding members L2 are placed parallel to the azimuth angle φ2.

Because each protruding member 3 has a predetermined height, when the display medium 1 is observed from a certain elevation angle, some areas of the display medium 1 are occluded by the protruding member 3 and some are not occluded. The observer viewing the display medium 1 from a certain elevation angle will see the areas not occluded by the protruding member 3.

Figure 3:
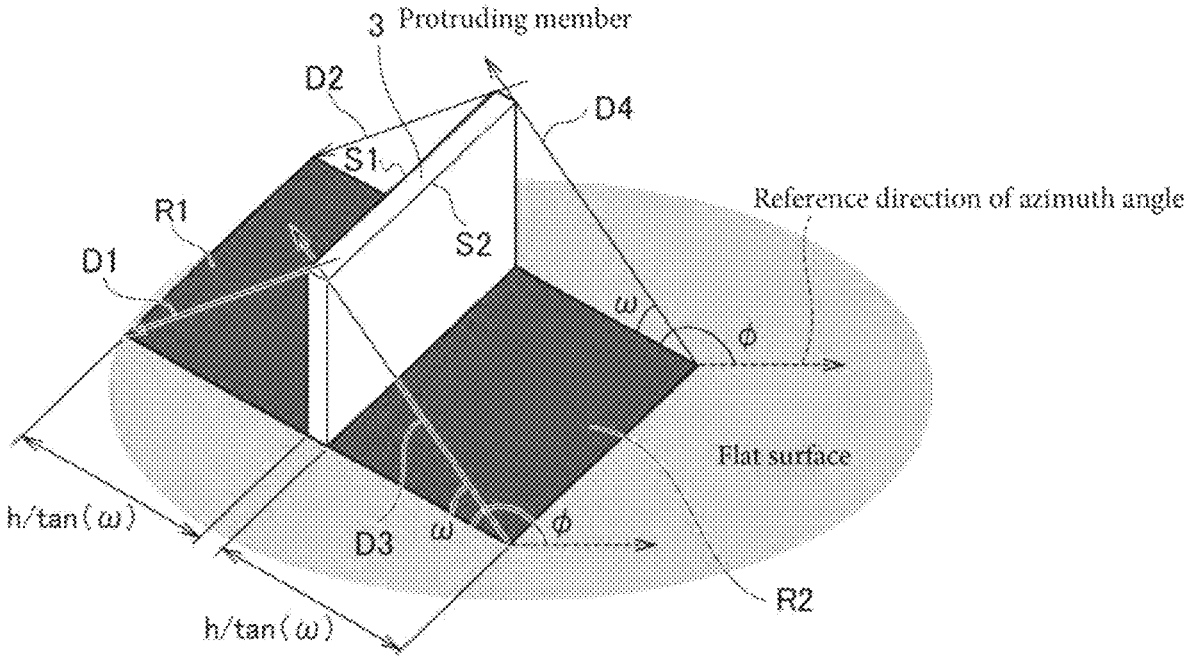
FIG. 3 illustrates an area where the protruding member occludes the light and an area where the protruding member does not occlude the light.

With reference to FIG. 3, the area where the protruding member 3 occludes the light is described. In FIG. 3, it is assumed that the observer is viewing from the elevation angle ω and the azimuth angle ψ. The height of the protruding member 3 is indicated by h.

First, the case in which the incident light is occluded by the protruding member 3 is discussed. As shown in FIG. 3, among the incident light entering at the predetermined elevation angle ω, the portions D1 and D2 of the incident light entering at positions higher than the edge S1, which is formed by the top surface of the protruding member 3 and the surface at the opposite side of the incident light source, hits the flat surface of the planar member 2 and be reflected forming the reflected light. On the other hand, the portions of the incident light entering at positions lower than the edge S1 is occluded by the protruding member 3. As a result, the color of the area R1 in front of the protruding member 3 at the opposite side of the incident light source is occluded by the protruding member 3. On the flat surface of the planar member 2, the area R1 extends out by h/tan (ω) from the placed position of the protruding member 3 in the opposite direction from the light source at the azimuth angle ψ.

The next discussion is for the case in which the incident light is reflected by the flat surface of the planar member 2 and subsequently the reflected light is occluded by the protruding member 3. As shown in FIG. 3, among the reflected light that is reflected at the predetermined elevation angle ω, portions D3 and D4 of the reflected light illuminating positions higher than the edge S2, which is formed by the top surface of the protruding member 3 and the surface facing the incident light source is viewed by the observer. On the other hand, the portion of the reflected light that is illuminating positions lower than the edge S2 is occluded by the protruding member 3. As a result, the color of the area R2 extending in the direction toward the incident light source from the protruding member 3 is occluded by the protruding member 3. On the flat surface of the planar member 2, the area R2 extends out by h/tan (ω) from the placed position of the protruding member 3 toward the incident light source at the azimuth angle ψ.

Figure 4A:
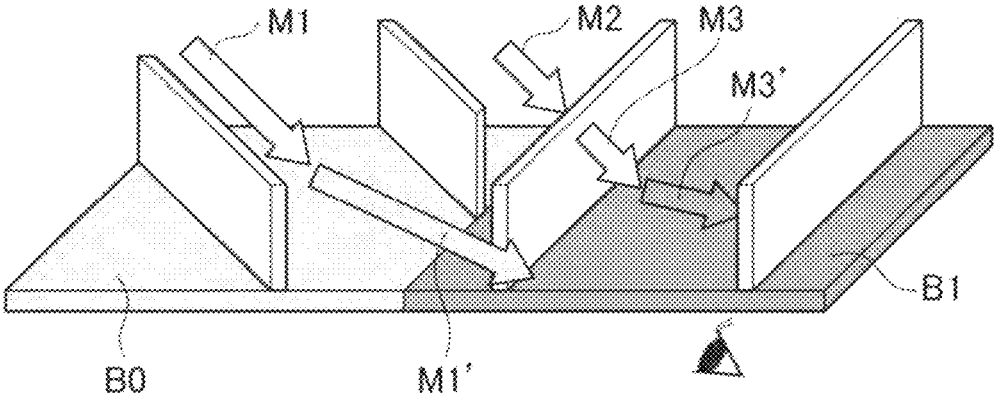
FIG. 4(*a*) is a diagram illustrating foe reflected light observed at a predetermined azimuth angle, and FIG. 4(*b*) is a diagram illustrating the reflected light observed at an azimuth angle different from FIG. 4(*a*).
Figure 4B:
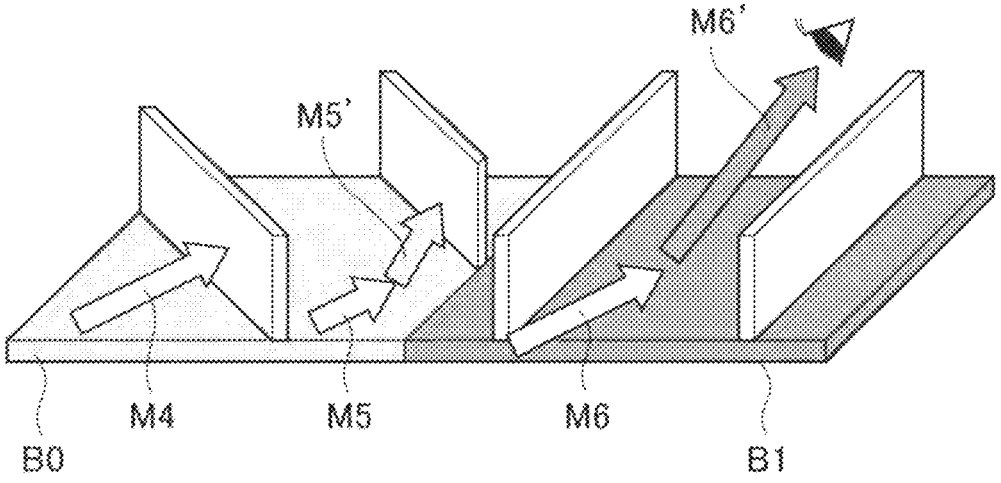

With reference to FIG. 4, the description is provided for the case in which the sub-cell B0 and the sub-cell B1 are observed from the predetermined elevation and azimuth angles. FIG. 4(*a*) and FIG. 4(*b*) has the same configuration of the sub-cells, but observers are viewing it from different azimuth angles (view points).

As shown in FIG. 4(*a*), since the observer is looking at the mirror-reflected light of the incident light, the viewing direction of the observer is 180 degrees different in azimuth but the same elevation angle with respect to the direction of the incident light. The incident light M1 entering the sub-cell B0 reaches the flat surface without being occluded by the protruding members. The incident light M1 is reflected by the flat surface of the sub-cell B0, and the reflected light M1' is generated. On the sub-cell B0, the reflected light M1' is parallel to the protruding member of the subcell B0. In other words, the line, which is the projected image of the reflected light M1' on the sub-cell B0, is parallel to the protruding members on the sub-cell B0. Thus, the reflected light M1' is not occluded by the protruding members of the sub-cell B0, and the observer can see the reflected light M1'. The reflected light M1' has the same color as the color of the sub-cell B0.

The protruding members in the sub-cell B1 are configured such that they are not parallel to the protruding members of the sub-cell B0. Thus, the incident light M2 entering the sub-cell B1 is occluded by a protruding member in the sub-cell B1 and does not reach the flat surface of the sub-cell B1. Thus, the observer cannot see any reflected light of the incident light M2. The light M3 reaches the flat surface of the sub-cell B1 without being occluded by the protruding member, and the reflected light M3 is generated. However, the reflected light M3' is occluded by another protruding member in the sub-cell B1, and the observer cannot see the reflected light M3'.

As shown in FIG. 4 (*b*), since the observer is looking at the mirror-reflected light of the incident light, the viewing direction of the observer is 180 degrees different in azimuth but the same elevation angle with respect to the direction of the incident light. The incident light M4 entering the sub-cell B0 is occluded by a protruding member of the sub-cell B0 and does not reach the flat surface of the sub-cell B0. Thus, the observer cannot see the reflected light of the incident light M4. The incident light M5 reaches the flat surface of the sub-cell B0 without being occluded by the protruding member of the sub-cell B0, and the reflected light M5 is generated. However, the reflected light M5' is occluded by another protruding member of the sub-cell B0, and the observer cannot see the reflected light M5'.

On the other hand, the incident light M6 entering the sub-cell B1 reaches the flat surface of the sub-cell B1 without being occluded by the protruding member of the sub-cell B1. The incident light M6 is reflected by the flat surface of the sub-cell B1, and the reflected light M6' is generated. The reflected light M6' is parallel to the protruding members of the sub-cell B1. In other words, the line that is the projected image of the reflected light M6' on the sub-cell B1 is parallel to the protruding members on the sub-cell B1. Thus, the reflected light M6' is not occluded by the protruding members of the sub-cell B1, and the observer can see the reflected light M6'. The reflected light M6' has the same color as the color of the sub-cell B1.

When the display medium 1 having the sub-cells B0 and B1 as shown in FIGS. 4(*a*) and (*b*) is observed from the set of the elevation angle and the azimuth angle as shown in FIG. 4(*a*), the reflected light M1' with the color of the sub cell B0 can be seen. When observed from the set of the elevation angle and the azimuth angle as shown in FIG. 4 (*b*), the reflected light M6' with the color of the sub-cell B1 can be seen. Thus, if the display medium 1 is observed from different azimuth angles, the observer can see only the color of the specific sub-cell at a given azimuth angle. Additionally, other unit cells are configured in a similar manner. On each sub-cell B of a unit cell C, the protruding members 3 are configured such that there is a flat surface on the planar member 2 parallel to a corresponding azimuth angle with respect to each sub-cell B.

Thus, if the display medium 1 is viewed from a predetermined azimuth angle, the observer sees the color of the sub-cell B0, for example, of each of the plurality of unit cells C. Thus, the observer can see the content composed of sub-cells B0 of all unit cells C. When viewed from another different azimuth angle, the observer sees the color of the sub-cell B1, for example, of each of the plurality of unit cells C, and sees the content composed of sub-cells B1 of all unit cells C. Thus, the display medium 1 can display a plurality of contents corresponding to azimuth angles from which the observer views the display medium 1.

Figure 5A:
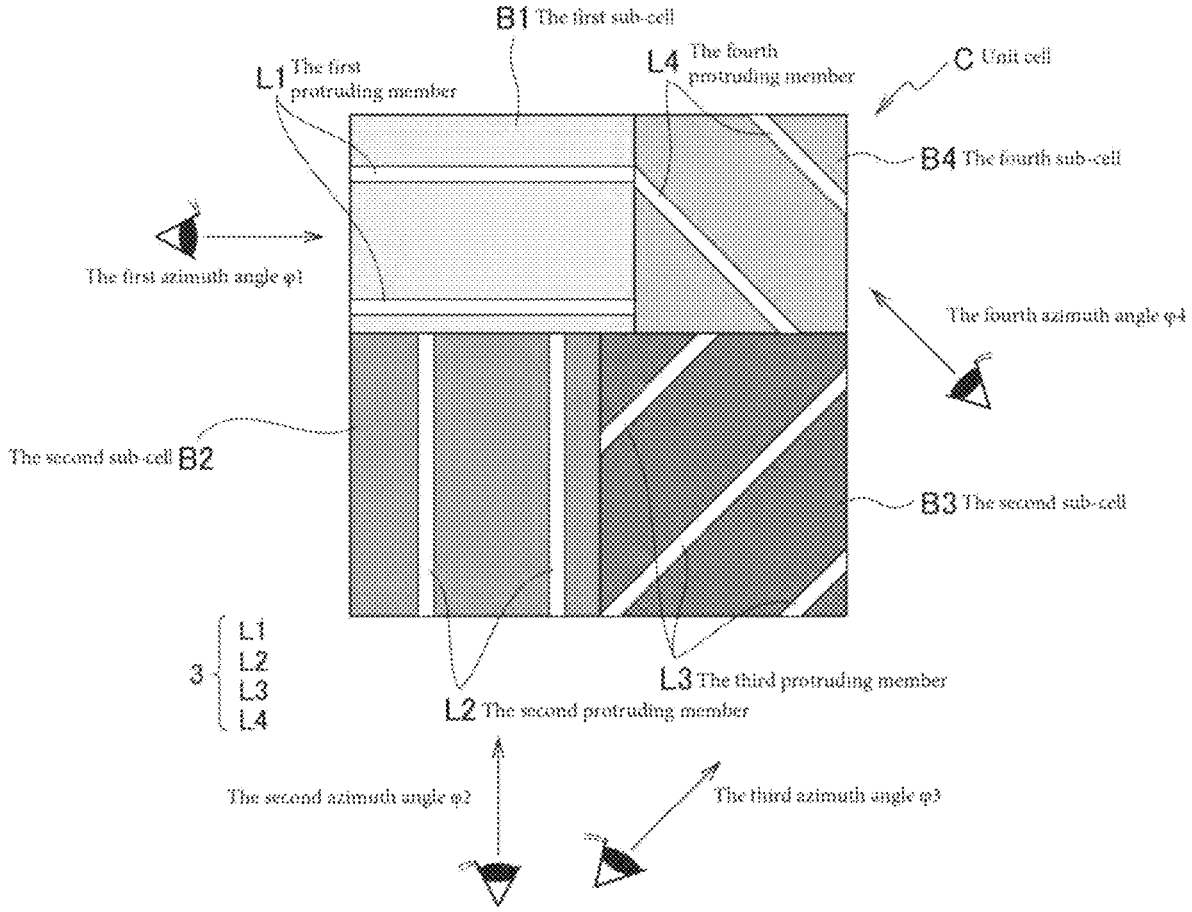
FIG. 5(*a*) is a top view of the unit cell pertaining to the embodiment of this invention.
Figure 5B:
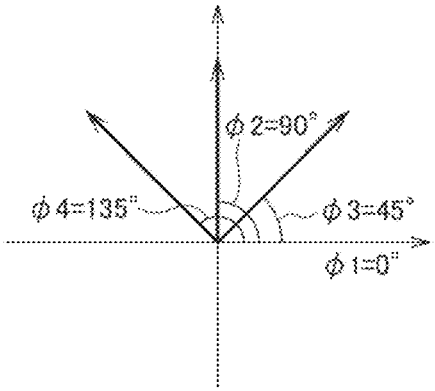
Figure 6A:
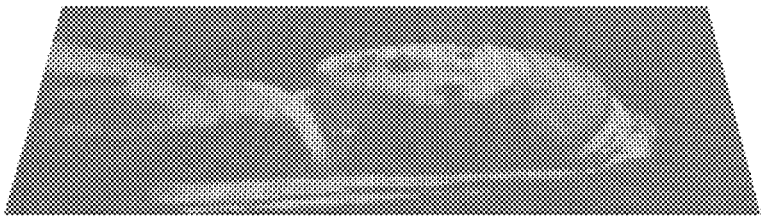
FIG. 6 illustrates an example of different contents that can be observed from each azimuth angle using the unit cell as shown in FIG. 5(*a*).
Figure 6B:
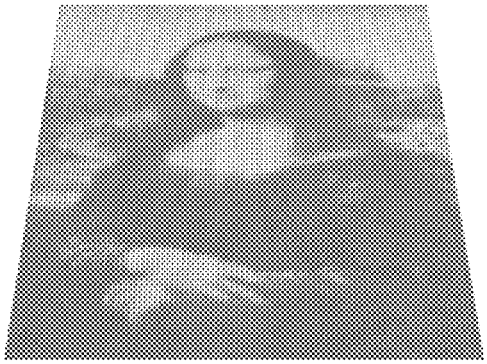
Figure 6C:
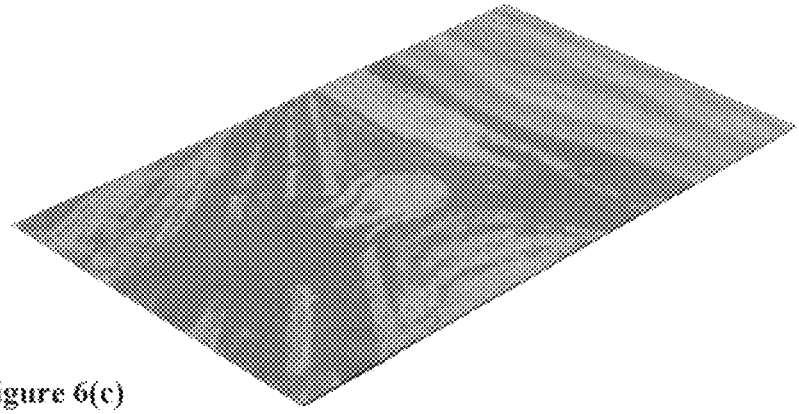
Figure 6D:
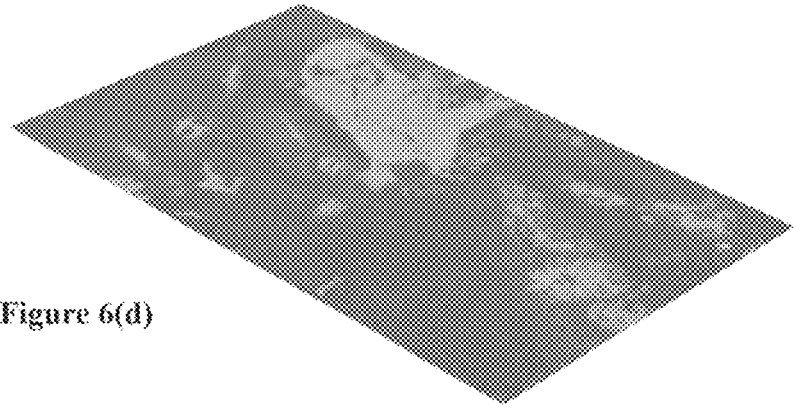

With reference to FIG. 5, the unit cell C that can display four or more contents is described. The unit cell C shown in FIG. 5(*a*) is provided with the first sub-cell B1, the second sub-cell B2, the third sub-cell B3 and the fourth sub-cell B4. Each sub-cell is colored with the color of the corresponding position of the content.

On the first sub-cell B1, two first protruding members L1 are placed parallel to each other in the direction of the azimuth angle φ1. Similarly, on the second sub-cell B2, two second protruding members L2 are placed parallel to each other in the direction of the azimuth angle φ2. On the third sub-cell B3, two third protruding members L3 are placed parallel to each other in the direction of the azimuth angle φ3. On the fourth sub-cell B4, two fourth protruding members L4 are placed parallel to each other in the direction of the azimuth angle φ4. The first protruding members L1, the second protruding members L2, the third protruding members L3 and the fourth protruding members L4 are so oriented that they are not parallel to any other.

The display medium 1 pertaining to the embodiment of this invention is configured to display contents corresponding to a predetermined azimuth angle when observed from the predetermined elevation angle at a plurality of azimuth angels. More specifically, when the display medium 1 is viewed from the first azimuth angle φ1, the color of the sub-cell B1 can be observed, but the most of colors of other sub-cells are occluded by respective protruding members. The color of the second sub-cell B2 is occluded by the protruding members L2, the color of the sub-cell B3 is occluded by the protruding members L3, and the color of the sub-cell 4 is occluded by the protruding members L4. Similarly, when the display medium 1 is viewed from the second azimuth angle φ2, the color of the sub-cell B2 can be observed. When the display medium 1 is viewed from the third azimuth angle φ3, the color of the sub-cell B3 can be observed. When the display medium 1 is viewed from the fourth azimuth angle φ4, the color of the sub-cell B4 can be observed.

The viewing azimuth angles described in FIG. 5(*a*) are shown in FIG. 5 (*b*). When the First azimuth angle is φ1 set as 0 degrees, the second azimuth angle φ2, the third azimuth angle φ3 and the fourth azimuth angle φ4 are set counter-clockwise to be 90 degrees, 45 degrees, and 135 degrees respectively. When sub-cells are configured as shown in FIG. 5(*a*), four types of contents can be observed if viewed at 0 degrees azimuth, 45 degrees azimuth, 90 degrees azimuth, and 135 degrees azimuth, and all at a predetermined elevation angle.

More specifically, as shown in FIG. 6, four types of contents (images) can be observed; one content (image) at each respective viewing angle. At the viewing angle of 0 degrees azimuth, the colors of the first sub-cells B1 of each unit cell C can be observed, and the image of the painting "The Girl with a Pearl Earring" by Johannes Vermeer as shown in FIG. 6(*a*) can be seen. At the viewing angle of 90 degrees azimuth, the colors of the second sub-cells B2 of each unit cell C can be observed, and the image of the painting "Mona Lisa" by Leonardo da Vinci as shown in FIG. 6 (*b*) can be seen. At the viewing angle of 45 degrees azimuth, the colors of the third sub-cells B3 of each unit cell C can be observed, and the image of the painting "The Scream" by Edvard Munch as shown in FIG. 6(*c*) can be seen. At the viewing angle of 135 degrees azimuth, the colors of the fourth sub-cells B4 of each unit cell C can be observed, and the image of the painting "The Procuress" by Johannes Vermeer as shown in FIG. 6(*d*) can be seen. In the examples shown FIG. 6, the heights, spacing, etc. of protruding members are optimized so that the contents can be best observed at the elevation angle of 30 degrees.

As described above, the display medium 1 is partitioned into a plurality of unit cells C, each unit cell C is further partitioned into a plurality of sub-cells B, and the protruding members 3 are configured on each sub-cell B such that toe protruding members on one sub-cell B are not parallel to protruding members 3 on any other sub-cells B. As a result, the display medium 1 pertaining to the embodiment of this inversion can display a predetermined number of contents corresponding to a predetermined number of azimuth angles at a predetermined elevation angle.

The display medium 1 pertaining to the embodiment of this invention can be applied to any size. For example, if the size is relatively small such as the A4 size or a few centimeter square, the display medium 1 can be configured by printing the protruding members 3 and colors of the colored parts 4 on the planar member 2. For example, the UV (ultraviolet) printer can be used to color the colored parts 4, and the fine concave-convex patterns of the protruding members 3 can be configured by hardening the UV resin. On the other hand, if the display medium 1 is relatively large such as a signboard, the display medium 1 may be configured by providing a board composed of the painted planar member 2 and arranging boards as the protruding members on the planar member 2.

The factors such as the amount of content that the display medium 1 can display, the size of the unit cell C, the size of the sub-cell B, the shapes of the protruding members 3, and the number of the protruding members to be provided on one sub-cell B are appropriately adjusted depending on the size of the display medium 1, the desired resolution, etc. For example, if the size of the display medium 1 is approximately the A4 size, the size of the unit cell C is approximately 1 mm and about three to five protruding members 3 are configured on one sub-cell B.

Processing Apparatus

Figure 7:
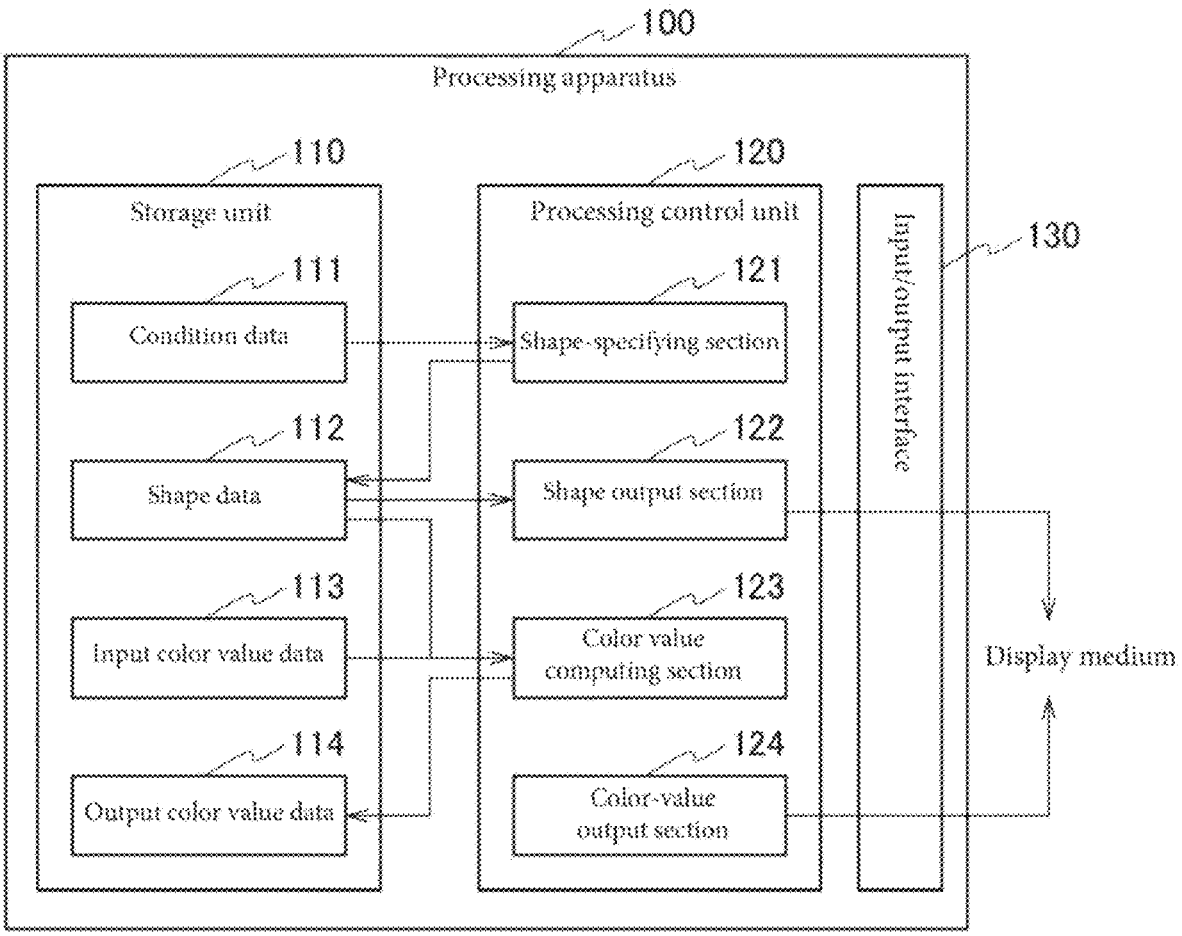
FIG. 7 is a diagram illustrating a hardware configuration and functional blocks of a processing apparatus used to configure the display medium pertinent to an embodiment of this invention.

With reference to FIG. 7, the processing apparatus 100 that is used to configure the display medium 1 pertaining to the embodiment of this invention will be discussed. The processing apparatus 100 is a general computer comprising the storage unit 110, the processing control unit 120 and the input/output interface 130. A general computer becomes the processing apparatus 100 having functions as shown in FIG. 7 by executing the processing program to execute the predetermined processes.

The storage unit 110 comprises ROM (Read Only Memory), RAM (Random access memory), hard disk, etc., and stores various data such as the input data, output data, intermediate data that are needed by the processing control unit 120 for executing various processes. The processing control unit 120 is a CPU (Central Processing Unit) and executes processes on the processing apparatus 100 such as read/write data stored in the storage unit 110, and input/output data in conjunction with the input/output interface 130. The input/output interface 130 provides the interface between the processing control unit 120 and the external apparatus (not shown in the diagrams). In the embodiment of this invention, the input/output interface 130 interfaces with the manufacturing apparatus of the display medium 1 or the readable memory device of the manufacturing apparatus of the display medium 1.

The storage unit 110 stores the condition data 111, the shape data 112, the input color value data 113, and the output color value data 114.

The condition data 111 are necessary data for the processing control unit 120 to execute processes. More specifically, the condition data 111 contains data such as the amount of content to be displayed on the display medium 1, elevation angles and azimuth angles. The colors of the protruding members 3 may be included in the condition data 111.

The shape data 112 is related to the shapes of the unit cells C, the sub-cells B and the protruding members 3 that are provided on the display medium 1. For example, the shape data 112 includes items such as the area ratio of each sub-cell B in the unit cell C of the display medium 1, the height of the protruding member 3, the position and the spacing between protruding members 3. The shape data 112 is generated by the shape-determining section 121.

The input color value data 113 is the color value data of the content to be displayed on the display medium 1. The input color value data 113 stores the color value of each unit cell C of each content corresponding to the predetermined number of azimuth angles. The input color value data 113 is kept by corresponding each display content with the applicable azimuth viewing angle of the content. Furthermore, the input color value data 113 is kept by corresponding the color value to be assigned to each sub-cell with the position of the sub-cell on the display medium 1.

The output color value data 114 makes each position on the display medium 1 correspond with the color value to be given for the position. The output color value data 114 is generated by the color value computing section 123.

The input color value data 113 and the output color value date 114 are in the format that can specify the colors to be given to the display medium 1. For example, the color value may be expressed in color codes or in values of RGB.

The processing control unit 120 comprises the shape-determining section 121, the shape output section 122, the color value computing section 123, and the color-value output section 124.

Based on the conditions specified in the condition data 111, the shape-determining section 121 determines the shape of the display medium 1 and generates the shape data 112. The shape-determining section 121 determines the shape of the protruding members 3 and the area ratio for each sub-cell B on the unit cell C to reduce: the amount of light being occluded by the protruding members 3 of the predetermined sub-cell B when viewed from the predetermined azimuth angle; the amount of light from directions other than the predetermined direction or from sub-cells B other than the predetermined sub-cell B; and the standard deviation of the reflected luminance of the sub-cells B. More specifically, the shapes of the protruding members 3 are determined in terms of the height, spacing, position, etc.

The shape output section 122 outputs, via the input/output interface 130, the shape data 112 generated by the shape-determining section 121.

The color value computing section 123 generates the output color value data 114 using the input color value data 113 and the shape data 112 generated by the shape-determining section 121. The color value computing section 123 computes the color value to be assigned to each sub-cell B of the unit cell C so that the difference between the observable color value at a predetermined unit cell C (sub-cell B) when the display medium 1 is viewed from the predetermined elevation angle and azimuth angle and the color value at the corresponding position of the unit cell C stored in the input color value data 113 is minimized.

For example, when the display medium 1 is configured using a UV printer, the processing apparatus 100 outputs the shape data 112 and the output color value data 114 to the UV printer.

The sequence and procedure of creating the display medium 1 is set appropriately. For example, if the display medium 1 is configured using a UV printer by injecting ink, the ink or the UV resin is injected along the nozzle's direction of movement. More specifically, the ink with the color defined by the output color value data 114 is injected at the position of the sub-cell B on the planar member 2, and the UV resin is injected at the position of the protruding member 3. Alternatively, after injecting the ink with the color defined by the output color value data 114 at the position of the sub-cell B on the planar member 2, the protruding member 3 is formed.

Processes Performed by the Shape-Determining Section

The next discussion is how the shape-determining section 121 performs the processing to generate the shape data 112. In the embodiment of this invention, the planar member 2 is made of the metal with high contents of mirror reflecting elements and can produce very high mirror reflection. Therefore, it can be said that the direction of viewing and the direction of the incident light are mirror-reflection. Thus, the incident direction and the emitting direction can be uniquely obtained.

In here, the desired reflection function f for a certain direction $w_o$ is defined by the objective function of equation (1).

[Mathematical Expression 1]

$$\underset{f}{\operatorname{argmin}} \| f(x, \omega_o) - I(x) \| \qquad \text{Equation (1)}$$

$f(x, \omega_o)$: Reflection function at position $x$ on the sheet member and in direction $\omega_o$ $I(x)$: Color value corresponding to position $x$ of the input image In here, the color value is expressed in RGB. For the 8-bit case, there are 256 gradations. More specifically, an individual RBG value is [0, 1] and is set in 1/255 gradations.

Next, when N amount of content is displayed by the display medium 1, the emission direction for viewing the kth content and the color value at position x are defined by equation (2).

[Mathematical Expression 2]

$$\underset{f}{\operatorname{argmin}} \sum_{k=0}^{N-1} \| f(x, \omega_o^k) - I_k(x) \| \qquad \text{Equation (2)}$$

$\omega_o^k$: Emission direction corresponding to the $k^{th}$ content $I_k(x)$: Color value corresponding to position $x$ of the $k^{th}$ input image The reflection function corresponding to a predetermined direction can be expressed by the sum of functions of the reflection of each content with respect to the predetermined direction. It is defined by the equation (3).

[Mathematical Expression 3]

$$f(x, \omega_o^k) = \sum_{k=0}^{N-1} f_k(x, \omega_o^k) \quad \text{Equation (3)}$$

$f(x, \omega_o^k)$: Reflection function corresponding to direction $\omega_o$ $f_k$ Function indicating reflection of a sub-cell The reflection function corresponding to a predetermined direction can be decomposed into a function that indicates reflection intensity with respect to the direction and a function that indicates the color, defined by equation (4). The function that indicates the reflection intensity with respect to a direction is guided by the blocking of light by the protruding member 3. The function that indicates the color is guided by the mixing of colors. The range of both functions is [0,1].

[Mathematical Expression 4]

$$f_k = D_k(\omega_o^k) S_k(x) \quad \text{Equation (4)}$$

$D_k$: Function indicating reflection intensity with respect to a direction $S_k$: Function indicating color As shown in FIG. 4, it is ideal that when observed from a predetermined angle, only the color of the predetermined sub-cell is visible while colors of all other sub-cells are not visible. However, it is often difficult to attain an ideal objective. Therefore, it is preferable to compute the function that indicates the reflection intensity in order to satisfy the following conditions: as much light as possible can be reflected; the color of the predetermined direction is shown preferentially; and the same luminance is seen from any angle. Here, the evaluation function is defined by equation (5).

[Mathematical Expression 5]

$$E(G) = w_o E_o(G) + w_g E_g(G) + w_s E_s(G) \quad \text{Equation (5)}$$

G: Vector whose variables are the proportion of the sub-cell within a unit cell, height, spacing, and position of parallel protruding members.

$w_o$, $w_g$, $w_s$: Weighting factors for $E_o$, $E_g$, $E_s$ $E_o$: Amount of light occluded in the sub-cell corresponding to the specified direction $E_g$: Amount of light from sub-cells other than the sub-cell corresponding to the specified direction $E_s$: Standard deviation of reflected luminance of all sub-cells The amount of light occluded in the sub-cell corresponding to the specified direction is defined by equation (6). When the amount of light occluded in the sub-cell corresponding to the specified direction is low, it means that the amount of light of the sub-cell corresponding to the specified direction is high. In other words, the color of the specified direction is preferentially seen.

[Mathematical Expression 6]

$$E_o(G) = \sum_{k=0}^{N-1} (1 - D_k(\omega_o^k; G)) \quad \text{Equation (6)}$$

$D_k(\omega_o^k; G)$: $D_k(\omega_o^k)$ when $G$

The amount of light from sub-cells other than the sub-cell of the specified direction is defined by equation (7). When the amount of light tom sub-cells other than the sub-cell of the specified direction is low, it indicates that the amount of light interfering with the light of the sub-cell of the specified direction is low.

[Mathematical Expression 7]

$$E_g(G) = \sum_{k=0}^{N-1} \sum_{l=0, l \neq k}^{N-1} D_l(\omega_o^k; G) \quad \text{Equation (7)}$$

Figure 8A:
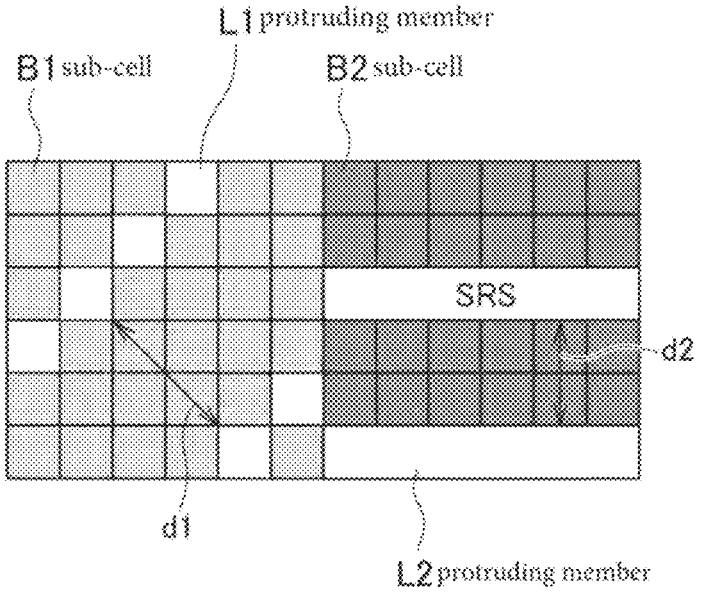
FIG. 8 illustrates observable peripheral sub-cells when a predetermined sub-cell is observed from a predetermined azimuth angle.
Figure 8B:
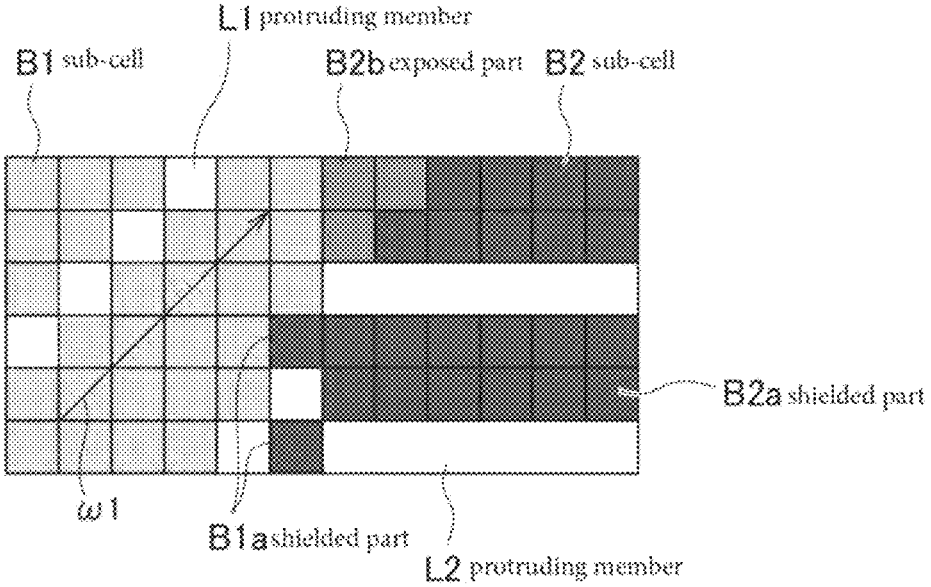

For example, as shown in FIG. 8(*a*), the first protruding member L1 is formed on the first sub-cell B1 and the second protruding member L2 is formed on the second sub-cell B2. When they are viewed from the predetermined azimuth angle ω as shown in FIG. 8 (*b*), the light reflected by the first sub-cell B1 can be observed. However, there are cases in which the light is occluded by the first protruding member L1 on the first sub-cell B1. Additionally, on the second sub-cell B2, the occluded part B2*a* by having the second protruding member L2 occluding the light and the exposed part B2*b* where the light is not occluded may be formed. Therefore, it is necessary for the shape-determining section 121 to generate the shape data 112 so that the light of the desired sub-cell can be observed easily.

For the observer to easily see the light of the first sub-cell B1 in the specified direction of the first sub-cell B1, it is preferable to increase the amount of light of the first sub-cell B1 in the specified direction of the first sub-cell B1 and to reduce the amount of light being occluded in the first sub-cell B1 in the specified direction of the first sub-cell B1. Similarly, it is preferable to increase the amount of light of the first sub-cell B1 in the specified direction of the second sub-cell B2 and to reduce the amount of light being occluded in the first sub-cell B1 in the specified direction of the first sub-cell B1.

Equation (6) computes the sum of the amount of the occluded light of the first sub-cell B1 in the specified direction of the first sub-cell B1 and the amount of the occluded light of the second sub-cell B2 in the specified direction of the second sub-cell B2.

In order for the observer to easily see the light of the first sub-cell B1 in the specified direction of the first sub-cell B1, it is preferable, when viewed from the specified direction of the first sub-cell B1, to reduce the amount of light from the second sub-cell B2 that is one of sub-cells other than the first sub-cell. Similarly, when viewed from the specified direction of the second sub-cell B2, it is preferable to reduce the amount of light from the first sub-cell B1.

Equation (7) computes the sum of the amount of light from the second sub-cell B2 when viewed from the specified direction of the first sub-cell B1 and the amount of light from the first sub-cell B1 when viewed from the specified direction of the second sub-cell B2.

The standard deviation of reflected luminance of all sub-cells is defined by equation (8). When the standard deviation of reflected luminance of all sub-cells is low, it indicates that the overall display medium 1 is displayed in similar luminance and is easier to see.

[Mathematical Expression 8]

$$E_s(G) = \sqrt{\frac{1}{N}\sum_{k=0}^{N-1}(D_k(\omega_o^k; G) - \overline{D})} \quad \text{Equation (8)}$$

$\overline{D}$: The average value of $D_k(\omega_o^k; G)$
(where $k$ is an integer from 0 to $N-1$)

Equation (5) computes the vector G so as to minimize the sum of predetermined weighted values of elements determined by equations (6) through (8). The predetermined weighting may be assigned by a user in advance. The variables of the vector G are the area ratio of a sub-cell within a unit cell, the height, spacing and position of the parallel protruding members. In other words, equation (5) computes the optimum area ratio of a sub-cell B and the optimum shape of the protruding member 3, which will result in reduced occluding of the light of the desired sub-cell in the desired direction, a smaller amount of light from sub-cells other than the desired sub-cell and in any direction other than the desired direction, and reduced differences among the reflected luminance of all sub-cells.

As is evident from the above mathematical equations, the sizes of sub-cells B in a unit cell C are not uniform and are appropriately adjusted. In the embodiment of this invention, the discussion was given for the case in which the vector G is computed using equations (6) through (8). However, only one of equations (6) through (8) may be used. Additionally, any other equations may be used.

In the embodiment of this invention, the vector G is computed to minimize the sum of predetermined weighted values of elements such as (1) the amount of light occluded by the protruding member in the predetermined sub-cell viewed from the predetermined direction, (2) the amount of light from directions other than the predetermined direction or from sub-cells other than the predetermined sub-cell, and (3) the standard deviation of reflected luminance of all sub-cells. However, the method of computing the vector G is not limited to the foregoing descriptions. For example, the vector G may be computed so as to reduce the value of the evaluation function that contains one or two elements from elements (1), (2) and (3) described above. Additionally, the vector G may be computed so as to reduce the value of the evaluation function that has predetermined weighting factors for elements.

Processes Performed by the Color Value Computing Section

Next, the processes performed by the color value computing section 123 to determine color of each sub-cell are described. The color value computing section 123 determines the color of each sub-cell B on the planar member 2 corresponding to the predetermined azimuth angle so that the sub-cell B, which is partitioned on the unit cell corresponding to specific content among the predetermined number of contents, will have the color (of the specific position) of the specific content (sub-cell B). In here, the color of the sub-cell B is compensated by considering the colors of peripheral sub-cells that are visible via the predetermined azimuth angle.

More specifically, the color of each sub-cell is solved using equation (2). In here, it is assumed that the color of the protruding member 3 is black. Equation (2) can be expanded into equation (9). Equation (9) determines the color of each sub-cell by considering the colors of all other sub-cells that are visible via the predetermined azimuth angle but not corresponding to the predetermined azimuth angle. As a result, the observer can see the high-quality content.

[Mathematical Expression 9]

$$\underset{S_k}{\operatorname{argmin}} \sum_x \sum_{k=0}^{N-1} \|D_k(\omega_o^k)S_k(x) + \rho(\omega_o^k)S_K - I_k(x)\| \quad \text{Equation (9)}$$

$S_k(x)$: The color of the sub-cell at position of the $k^{th}$ content
$S_K$: The color of the protruding member
$\rho(\omega_o^k)$: The function of the visible level of the protruding member dependent on the direction When the display medium 1 is observed, there is a possibility that a desired luminance may not be obtained. Therefore, it is preferable to make adjustments by applying a coefficient a to the color value of the input image. By using a coefficient a, equation (9) is expanded as shown in equation (10). The color of each sub-cell is determined by equation (10).

[Mathematical Expression 10]

$$\underset{S_k\alpha}{\operatorname{argmin}} \sum_x \sum_{k=0}^{N-1} \|D_k(\omega_o^k)S_k(x) + \rho(\omega_o^k)S_K - \alpha I_k(x)\|/\alpha \quad \text{Equation (10)}$$

$\alpha$: coefficient

The display medium 1 pertaining to the embodiment of this invention is suitable for displaying different contents depending on different azimuth viewing angels. For example, the display medium 1 can display unique information corresponding to each position of observers when there are a plurality of observers viewing from different viewing angles.

First Embodiment Variation

The embodiment of this invention is described using the configuration in which the display medium 1 is configured by providing the colored part 4 and the protruding member 3 on to the planar member 2. The principles of this invention described using the embodiment of this invention can be realized in other embodiments.

Figure 9:
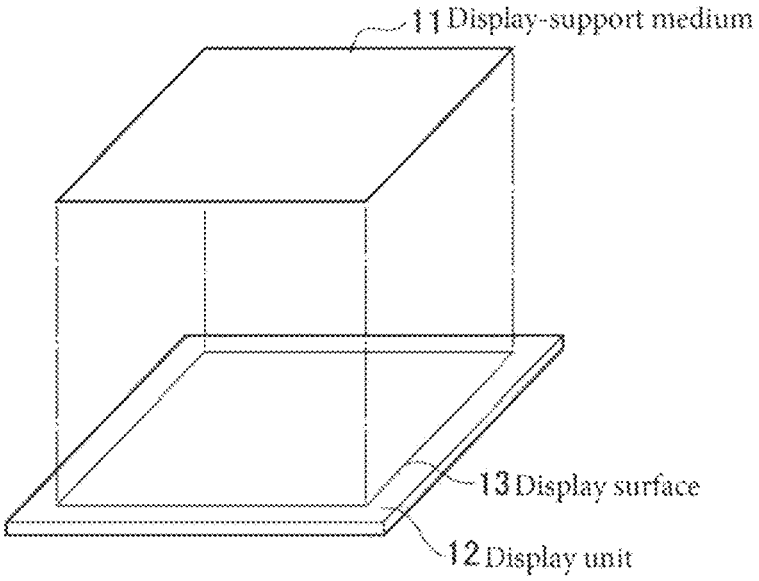
FIG. 9 is a diagram illustrating a display-support medium pertinent to a first embodiment variation of this invention.

In a first embodiment variation as shown in FIG. 9, the display-support medium 11 is configured with the protruding members 3 as described in the embodiment of this invention formed on the sheet member having a sheet form that transmits light. Then, the display-support medium 11 is attached to the display surface 13 of the generic display unit 12 that reflects the light. In conjunction with the unit cells C, sub-cells B and the shapes of the protruding members 3 configured on the display-support medium 11, the display unit 12 displays the image determined by the colors of sub-cells. In other words, the display unit 12 realizes the colored parts 4 pertaining to the embodiment of this invention through the electrical means.

In this manner, a different content can be observed from each azimuth angle as in the embodiment of this invention. The sheet member used for the display-support medium 11 is preferably made of a transparent material that transmits light, but it may be made of a partially transparent material so long as the visibility of the observer is not affected. The display unit 12 in here is a liquid crystal display (LCD), an organic electroluminescence display (organic EL display), etc. It is preferable to utilize bright backlighting or bright light emitting elements.

Since the display unit 12 can display any image, an appropriate image can be displayed in accordance with any conditions. Additionally, by having the display unit 12 change the image successively, a different movie content can be observed from each azimuth viewing angle.

Since the image displayed by the display unit 12 corresponds to the sub-cells configured on the display-support medium 11, an appropriate alignment is performed to properly attach the display-support medium 11 on to the display surface 13.

Figure 10:
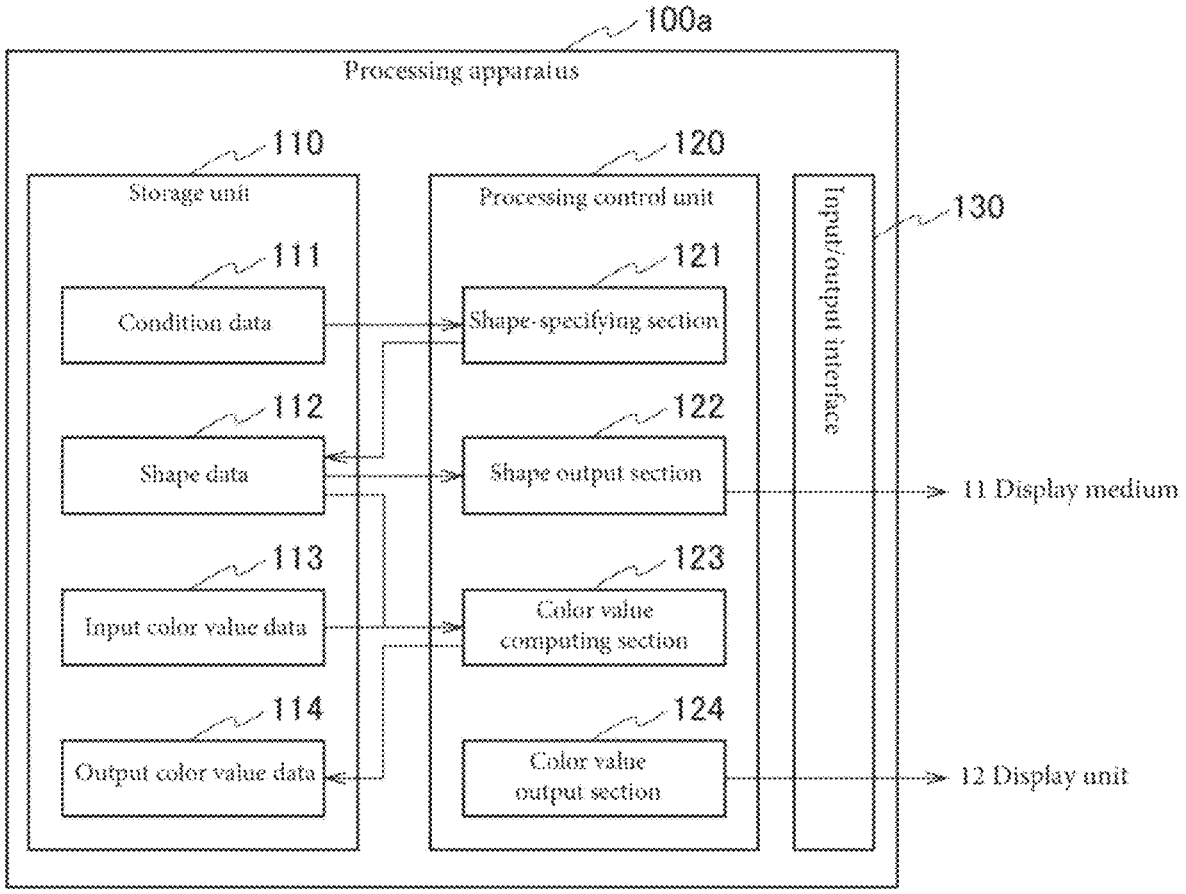
FIG. 10 is a diagram illustrating a hardware configuration and functional blocks of the processing apparatus used to configure the display medium pertinent to the first embodiment variation of this invention.

In the first embodiment variation, the processing apparatus 100*a* as shown in FIG. 10 is used for creating the appropriate display-support medium 11 and for displaying an appropriate image on the display unit 12. The processing apparatus 100*a* pertaining to the first embodiment variation is similar to the processing apparatus 100 described in FIG. 7 but has different data output destinations. The shape output section 122 outputs the shape data 112, via the input/output interface 130, to the manufacturing apparatus of the display-support medium 11 or to the readable memory device of the manufacturing apparatus of the display-support medium 11. The color-value output section 124 outputs the output color value data 114 to the display unit 12 on which the display-support medium 11 is attached or to the readable memory device of the display unit 12.

The display-support medium 11 pertaining to the first embodiment variation is suitable for displaying different image depending on different azimuth viewing angels. For example, the display-support medium 11 attached on the display unit 12 can display unique information corresponding to each position of observers and other conditions when there are a plurality of observers viewing from different viewing angles.

Second Embodiment Variation

Figure 11:
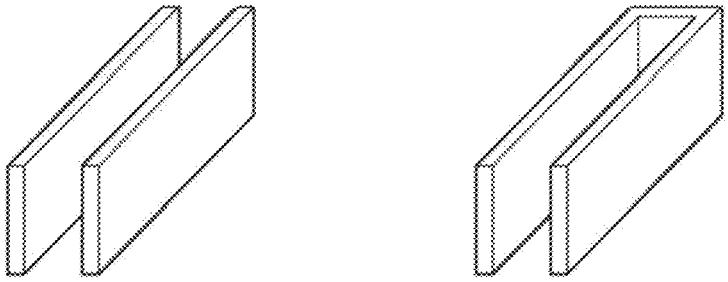
FIG. 11 illustrates the shapes of the protruding member pertaining to a second embodiment variation of this invention.

In the embodiment of this invention, the protruding member 3 is described for the case in which it is a board-shaped member as shown in FIG. 11(*a*), but it is not limited to this configuration. It can be configured into a U-shaped member, as shown in FIG. 11(*b*), by linking board-shaped members. When linking, the portion linking the board-shaped members is placed on the border of the sub-cells B or the unit cells C.

Third Embodiment Variation

In the embodiment of this invention, the description is provided for the case in which a predetermined content can be observed from the predetermined elevation and azimuth angles. In a third embodiment variation, the case will be discussed in which an extra content, beyond the predetermined number of contents observable at the predetermined elevation angle, can be seen at an elevation angle different from the predetermined elevation angle.

Figure 12:
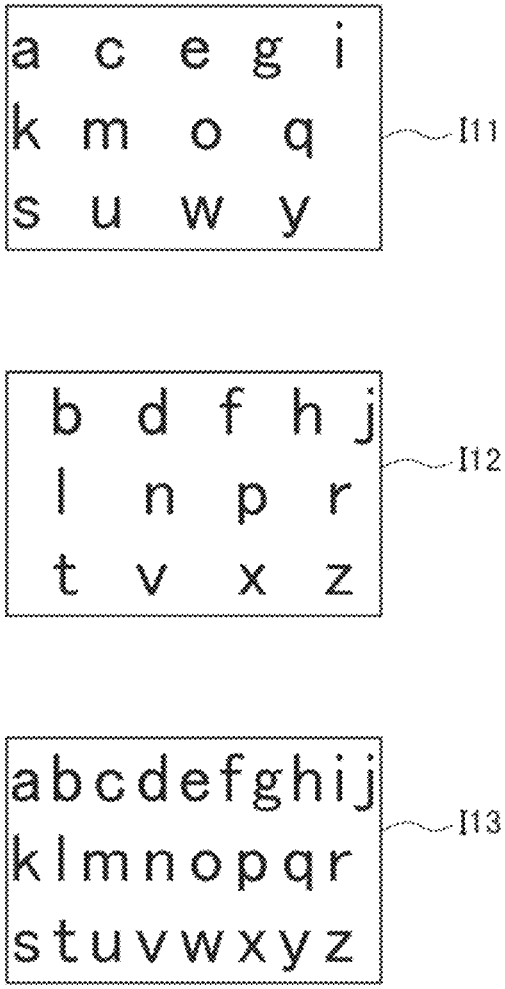
FIG. 12 is a diagram, for a third embodiment variation of this invention, illustrating the different content which can be observed when viewed from the elevation angle of 90 degrees.

FIGS. 12(*a*) and (*b*) are examples of contents observable at the predetermined elevation angle and the predetermined azimuth angles. When the image I11 of FIG. 1 (*a*) is observable at the predetermined elevation angle and a predetermined azimuth angle and the image I12 of FIG. 12(*b*) is observable at the predetermined elevation angle and another predetermined azimuth angle, the image I13 as shown in FIG. 12(*c*) can be observed if the elevation viewing angle is changed to 90 degrees (viewing the display medium 1 from the top).

Thus, each sub-cell can be colored so that a new content can be displayed when observed at an elevation angle different from the predetermined elevation angle.

Fourth Embodiment Variation

In equations (1) through (10) described in the embodiment of this invention, the color of the protruding member 3 is assumed to be black that can easily occlude the light. However, it is possible to set any color.

For example, in FIG. 3, when the color of the protruding member 3 is other than black and occludes some wavelengths of the light but transmits other wavelengths of the light, the portion of the light that passes through the protruding member 3 at the area R1 and reflects at the area R2 will have the blending of the color of the protruding member 3 and the color of the colored part 4 of the planar member 2. For example, as far as for the areas R1 and R2, the observer recognizes the content displayed by the display medium 1 as the color going through the colored filter of the protruding member 3.

Thus, when the protruding member 3 is set to any color other than black, a portion of the light is occluded and other portion passes through impacting the reflected color with the color of the protruding member 3. In this case, the color of each sub-cell is determined by equation (11). The final resultant color of the light that passes through the protruding member 3 is defined by considering not just one transmission or refraction but the color after being reflected at the planar member 2. The color of the protruding member 3 may be changed for each sub-cell where it is placed.

[Mathematical Expression 11]

$$\underset{S_k \alpha}{\operatorname{argmin}} \sum_{x} \sum_{k=0}^{N-1} \|D_k(\omega_o^k)S_k(x) + \rho(\omega_o^k)S_K S_s - \alpha I_k(x)\|/\alpha \qquad \text{Equation (11)}$$

$S_K$: The color of the protruding member $S_s$: The color after passing through the protrudingmember In the above-described equation, the color of the sub-cell is set by considering not only the amount of light reflecting at the sub-cell corresponding to the predetermined azimuth angle but also the amount of the observable light reflecting at the peripheral sub-cells.

Thus, it is possible to display a sharper image by setting the color of the protruding member 3 in accordance with the color of the content to be shown at each sub-cell.

Other Embodiment

This invention has been described with reference to the embodiment and the embodiment variations (1) through (4) of the embodiment. The description and the accompanying drawings are part of this disclosure and should not be regarded as limiting the invention. Those skilled in the art will readily recognize from such discussion that various alternative embodiments, examples and methods can be made.

For example, the processing apparatus described in FIGS. 7 and 10 may be configured with a plurality of hardware devices and may be implemented with another computer that can perform processing.

This invention, of course, includes various embodiments that are not described here. Thus, the technical scope of this invention is defined only by the matters used to specify this invention pertaining to the scope of claims of this invention that are valid and reasonable, based on the descriptions provided above.

EXPLANATION OF REFERENCE CODES

1 Display medium
2 Planar member
3 Protruding member
4 Colored part
11 Display-support medium
12 Display unit
100 Processing apparatus
110 Storage unit
111 Condition data
112 Shape data
113 Input color value data
114 Output color value data
120 Processing control unit
121 Shape-determining section
122 Shape output section
123 Color value computing section
124 Color-value output section

The invention claimed is:

1. A display medium capable of displaying a predetermined number of contents corresponding to a predetermined number of azimuth angles when viewed from predetermined elevation and azimuth angles, comprising:

a planar member that reflects light, wherein the planar member is partitioned into a plurality of unit cells, each of the plurality of unit cells is further partitioned into a predetermined number of sub-cells corresponding to the predetermined number of the azimuth angles, and in each sub-cell corresponding to a predetermined azimuth angle, a protruding member is formed vertically on the planar member, wherein a surface of the protruding member is configured to occlude light and wherein the surface of the protruding member is parallel to the direction of the predetermined azimuth angle on the planar member.

2. A processing apparatus that is used for manufacturing the display medium described in claim 1, comprising:

a storage unit that stores the number of contents to be displayed by the display medium, condition data including elevation angles and azimuth angles, and input color value data storing a color value for each unit cell with respect to each content corresponding to the predetermined number of azimuth angles;

a shape-determining section that determines an area ratio of each sub-cell and a shape of the protruding Member to reduce: the amount of light being occluded by the protruding member when light of a predetermined sub-cell is viewed from a predetermined azimuth angle; the amount of light from the directions other than a predetermined direction or from sub-cells other than the predetermined sub-cell; or the standard deviation of the reflected luminance among sub-cells; and a color value computing section that computes a color value to be assigned to each sub-cell of the unit cell in a manner that the difference between an Observable color value at a predetermined unit cell when the display medium is observed from the predetermined elevation and azimuth angles, and a Color value at a corresponding position of the unit cell stored in the input color value data becomes small.

3. A non-transitory computer readable medium storing a processing program for operating a computer as the processing apparatus as described in claim 2.

4. The display medium of claim 1, further comprising a plurality of colored portions on the planar member.

5. The display medium of claim 4, wherein each colored portion of the plurality of colored portions is colored with a color corresponding to a position of each sub-cell.

6. The display medium of claim 4, wherein the colored portion is colored by UV printing.

7. A display-support medium that is attachable to a display surface having a light-reflecting flat surface and is capable of displaying a predetermined number of contents corresponding to a predetermined number of azimuth angles when viewed from predetermined elevation and azimuth angles, comprising:

a sheet member having a sheet form that transmits light, wherein the sheet member is partitioned into a plurality of unit cells, each of the plurality of unit cells is further partitioned into a predetermined number of sub-cells corresponding to the predetermined number of azimuth angles, and in each sub-cell corresponding to a predetermined azimuth angle, a protruding member is formed vertically on the sheet member, wherein a surface of the protruding member is parallel to the direction of the predetermined azimuth angle on the sheet member and configured to occlude light.

8. The display-support medium described in claim 7, wherein in each sub-cell of the unit cell, an area ratio of each sub-cell and a shape of the protruding member are configured in a manner that the protruding member occludes a smaller amount of the light of a predetermined sub-cell when viewed from a predetermined azimuth angle.

9. The display-support medium described in claim 7, wherein in each sub-cell of the unit cell, the area ratio of each sub-cell and the shape of the protruding member are configured in a manner that the amount of light from directions other than the predetermined direction or from sub-cells other than the predetermined sub cell is smaller.

10. The display-support medium described in claim 7, wherein in each sub-cell of the unit cell, the area ratio of each sub-cell and the shape of the protruding member are configured in a manner that standard deviation of reflected luminance of all sub-cells becomes small.

11. The display-support medium described in claim 7, wherein when viewed from different elevation angle other than the predetermined elevation angle, a content other than the predetermined number of contents can be displayed.

12. A processing apparatus that is used for manufacturing the display-support medium described in claim 7, comprising:

a storage unit that stores the number of contents to be supported by the display-support medium, condition data including elevation angles and azimuth angles, and input color value data storing a color value for each unit cell with respect to each content corresponding to the predetermined number of azimuth angles; and a shape-determining section that determines an area ratio of each sub-cell and a shape of the protruding member to reduce: the amount of light being occluded by the protruding member when light of a predetermined sub-cell is viewed from a predetermined azimuth angle; the amount of light from the directions other than a predetermined direction or from sub-cells other than the predetermined sub-cell; or the standard deviation of the reflected luminance among sub-cells.

13. A non-transitory computer readable medium storing a processing program for operating a computer as the processing apparatus as described claim 12.

14. A processing apparatus that is used to compute a color value of each position of the display surface corresponding to each sub-cell in order to display the predetermined number of contents on the display surface on which the display-support medium described in claim 7 is attached, comprising:

a storage unit that stores a color value far each unit cell with respect to each content corresponding to the predetermined number of azimuth angles; and a color value computing section that computes the color values to be assigned to each position of the display surface corresponding to each sub-cell of the unit cell in a manner that the difference between an observable color value at a predetermined unit cell when the display surface on which the display-support medium is attached is observed from the predetermined elevation and azimuth angles, and a color value at the corresponding position of the unit cell with respect to the content at the predetermined azimuth angle is minimized.

15. A non-transitory computer readable medium storing a processing program for operating a computer as the processing apparatus as described claim 14.

16. The display-support medium of claim 7, further comprising a plurality of colored portions on the sheet member.

17. The display-support medium of claim 16, wherein the colored portion is colored with a color corresponding tot position of each sub-cell.

18. The display-support medium of claim 16, wherein the colored portion is colored by UV printing.

* * * * *